US010717274B2

(12) United States Patent
Govyadinov et al.

(10) Patent No.: US 10,717,274 B2
(45) Date of Patent: Jul. 21, 2020

(54) FLUID EJECTION DEVICE

(71) Applicant: HEWLETT-PACKARD DEVELOPMENT COMPANY, L.P., Spring, TX (US)

(72) Inventors: Alexander Govyadinov, Corvallis, OR (US); Paul A. Richards, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/685,818

(22) Filed: Nov. 15, 2019

(65) Prior Publication Data

US 2020/0079085 A1 Mar. 12, 2020

Related U.S. Application Data

(63) Continuation of application No. 15/516,436, filed as application No. PCT/US2014/062894 on Oct. 29, 2014, now Pat. No. 10,500,850.

(51) Int. Cl.
*B41J 2/175* (2006.01)
*B41J 2/14* (2006.01)

(52) U.S. Cl.
CPC ..... *B41J 2/14056* (2013.01); *B41J 2/1404* (2013.01); *B41J 2/14088* (2013.01); *B41J 2/175* (2013.01); *B41J 2002/14467* (2013.01); *B41J 2202/12* (2013.01)

(58) Field of Classification Search
CPC .. B41J 2/14056; B41J 2/1404; B41J 2/14088; B41J 2/175
See application file for complete search history.

(56) References Cited

U.S. PATENT DOCUMENTS

| | | | | |
|---|---|---|---|---|
| 7,401,910 | B2 | 7/2008 | Silverbrook | |
| 7,587,822 | B2 * | 9/2009 | Silverbrook | B41J 2/1404 29/611 |
| 8,752,946 | B2 | 6/2014 | Wells | |
| 8,814,293 | B2 | 8/2014 | Strunk | |
| 2010/0177133 | A1 | 7/2010 | Makishima | |

(Continued)

FOREIGN PATENT DOCUMENTS

| | | |
|---|---|---|
| CN | 102971150 | 3/2013 |
| CN | 102985261 | 3/2013 |

(Continued)

OTHER PUBLICATIONS

Brand new wide-format inkjet printhead from Xaar, Jul. 3, 2014, http://www.printanddigitalcommunicationworld.com/brand-new-wide-format-inkjet-printhead-from-xaar/.

*Primary Examiner* — Lamson D Nguyen
(74) *Attorney, Agent, or Firm* — Fabian VanCott

(57) ABSTRACT

A fluid ejection device includes a fluid slot, a fluid ejection chamber communicated with the fluid slot, a drop ejecting element within the fluid ejection chamber, a fluid circulation channel communicated at one end with the fluid slot and communicated at another end with the fluid ejection chamber, a fluid circulating element within the fluid circulation channel, and a channel wall separating the fluid ejection chamber and the fluid circulation channel. The fluid circulation channel includes a channel loop, and a width of the channel wall is based on a width of the channel loop and a width of the fluid ejection chamber.

15 Claims, 6 Drawing Sheets

(56) References Cited

U.S. PATENT DOCUMENTS

| | | | | |
|---|---|---|---|---|
| 2011/0128335 | A1 | 6/2011 | Von Essen | |
| 2011/0181674 | A1 | 7/2011 | Kang | |
| 2013/0155135 | A1 | 6/2013 | Govyadinov | |
| 2013/0278688 | A1 | 10/2013 | Bibl | |
| 2013/0321507 | A1 | 12/2013 | Mardilovich | |
| 2014/0204148 | A1 | 7/2014 | Ge | |
| 2015/0049141 | A1 | 2/2015 | Taff | |
| 2015/0290943 | A1* | 10/2015 | Gomi | B41J 2/175<br>347/85 |

FOREIGN PATENT DOCUMENTS

| | | |
|---|---|---|
| CN | 103153627 | 6/2013 |
| WO | WO-2013130039 | 9/2013 |
| WO | WO-2014003772 | 1/2014 |
| WO | WO-2014084843 | 6/2014 |

* cited by examiner

| | Lower Level (μm) | Upper Level (μm) |
|---|---|---|
| Main Resistor Width (RW) | 10 | 22 |
| Main Resistor Length (RL) | 10 | >60 |
| Main Resistor Shelf Length (RS) | 0 | >60 |
| Pump Resistor Width (PRW) | 2 | 14 |
| Pump Resistor Length (PRL) | 5 | 50 |
| Pump Resistor Shelf Length (PRS) | near 0 | >60 |
| Main Resistor Chamber Width (ChW) | 14 | 26 |
| Main Resistor Chamber Length (ChL) | 12 | >62 |
| Circulation Channel Loop Width (CLW) | 5 | 16 |
| Circulation Channel Loop Length (CLL) | 0 | ~500 |
| Circulation Channel Offset (CO) | 0 | ±11 |
| Channel Wall Width (CW) | 5 | 11 |
| Peninsula Length (PL) | 0 | >>80 |

*FIG. 3*

FLUID EJECTION DEVICE

BACKGROUND

Fluid ejection devices, such as printheads in inkjet printing systems, may use thermal resistors or piezoelectric material membranes as actuators within fluidic chambers to eject fluid drops (e.g., ink) from nozzles, such that properly sequenced ejection of ink drops from the nozzles causes characters or other images to be printed on a print medium as the printhead and the print medium move relative to each other.

Decap is the amount of time inkjet nozzles can remain uncapped and exposed to ambient conditions without causing degradation in ejected ink drops. Effects of decap can alter drop trajectories, velocities, shapes and colors, all of which can negatively impact print quality. Other factors related to decap, such as evaporation of water or solvent, can cause pigment-ink vehicle separation (PIVS) and viscous ink plug formation. For example, during periods of storage or non-use, pigment particles can settle or "crash" out of the ink vehicle which can impede or block ink flow to the ejection chambers and nozzles.

BRIEF DESCRIPTION OF THE DRAWINGS

FIG. 3 is a table outlining example parameters and example ranges of the parameters of a fluid ejection device.

DETAILED DESCRIPTION

In the following detailed description, reference is made to the accompanying drawings which form a part hereof, and in which is shown by way of illustration specific examples in which the disclosure may be practiced. It is to be understood that other examples may be utilized and structural or logical changes may be made without departing from the scope of the present disclosure.

The present disclosure helps to reduce ink blockage and/or clogging in inkjet printing systems generally by circulating (or recirculating) fluid through fluid ejection chambers. Fluid circulates (or recirculates) through fluidic channels that include fluid circulating elements or actuators to pump or circulate the fluid.

Figure 1:
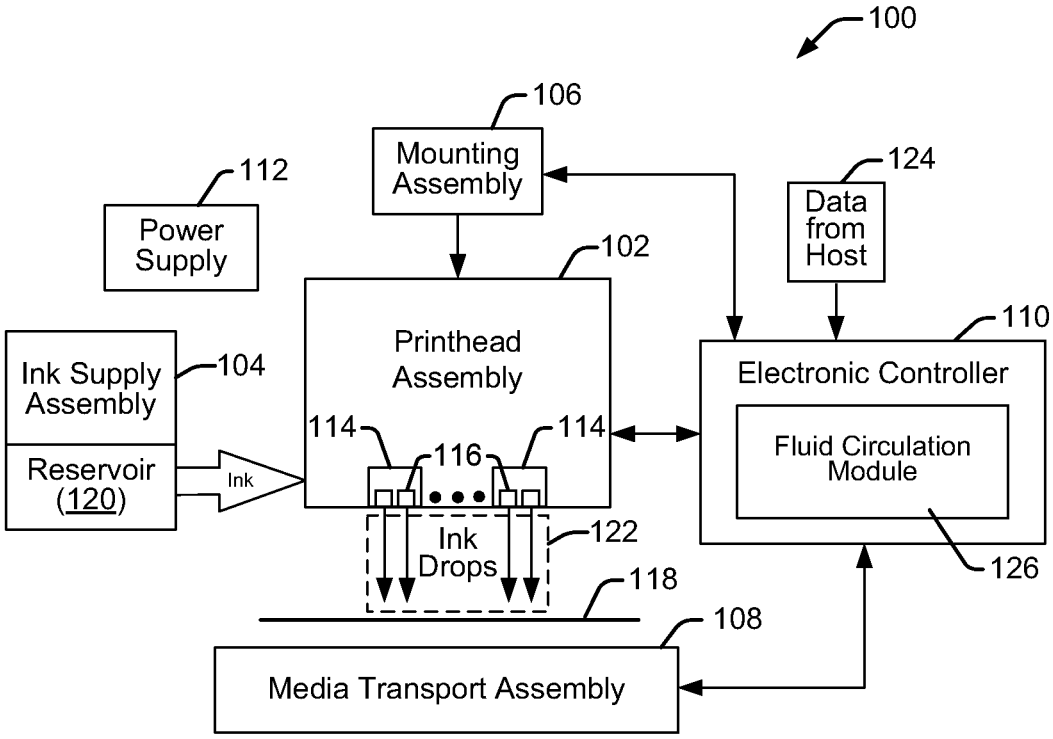
FIG. 1 is a block diagram illustrating one example of an inkjet printing system including an example of a fluid ejection device.

FIG. 1 illustrates one example of an inkjet printing system as an example of a fluid ejection device with fluid circulation, as disclosed herein. Inkjet printing system 100 includes a printhead assembly 102, an ink supply assembly 104, a mounting assembly 106, a media transport assembly 108, an electronic controller 110, and at least one power supply 112 that provides power to the various electrical components of inkjet printing system 100. Printhead assembly 102 includes at least one fluid ejection assembly 114 (printhead 114) that ejects drops of ink through a plurality of orifices or nozzles 116 toward a print medium 118 so as to print on print media 118.

Print media 118 can be any type of suitable sheet or roll material, such as paper, card stock, transparencies, Mylar, and the like. Nozzles 116 are typically arranged in one or more columns or arrays such that properly sequenced ejection of ink from nozzles 116 causes characters, symbols, and/or other graphics or images to be printed on print media 118 as printhead assembly 102 and print media 118 are moved relative to each other.

Ink supply assembly 104 supplies fluid ink to printhead assembly 102 and, in one example, includes a reservoir 120 for storing ink such that ink flows from reservoir 120 to printhead assembly 102. Ink supply assembly 104 and printhead assembly 102 can form a one-way ink delivery system or a recirculating ink delivery system. In a one-way ink delivery system, substantially all of the ink supplied to printhead assembly 102 is consumed during printing. In a recirculating ink delivery system, only a portion of the ink supplied to printhead assembly 102 is consumed during printing. Ink not consumed during printing is returned to ink supply assembly 104.

In one example, printhead assembly 102 and ink supply assembly 104 are housed together in an inkjet cartridge or pen. In another example, ink supply assembly 104 is separate from printhead assembly 102 and supplies ink to printhead assembly 102 through an interface connection, such as a supply tube. In either example, reservoir 120 of ink supply assembly 104 may be removed, replaced, and/or refilled. Where printhead assembly 102 and ink supply assembly 104 are housed together in an inkjet cartridge, reservoir 120 includes a local reservoir located within the cartridge as well as a larger reservoir located separately from the cartridge. The separate, larger reservoir serves to refill the local reservoir. Accordingly, the separate, larger reservoir and/or the local reservoir may be removed, replaced, and/or refilled.

Mounting assembly 106 positions printhead assembly 102 relative to media transport assembly 108, and media transport assembly 108 positions print media 118 relative to printhead assembly 102. Thus, a print zone 122 is defined adjacent to nozzles 116 in an area between printhead assembly 102 and print media 118. In one example, printhead assembly 102 is a scanning type printhead assembly. As such, mounting assembly 106 includes a carriage for moving printhead assembly 102 relative to media transport assembly 108 to scan print media 118. In another example, printhead assembly 102 is a non-scanning type printhead assembly. As such, mounting assembly 106 fixes printhead assembly 102 at a prescribed position relative to media transport assembly 108. Thus, media transport assembly 108 positions print media 118 relative to printhead assembly 102.

Electronic controller 110 typically includes a processor, firmware, software, one or more memory components including volatile and no-volatile memory components, and other printer electronics for communicating with and controlling printhead assembly 102, mounting assembly 106, and media transport assembly 108. Electronic controller 110 receives data 124 from a host system, such as a computer, and temporarily stores data 124 in a memory. Typically, data 124 is sent to inkjet printing system 100 along an electronic, infrared, optical, or other information transfer path. Data 124 represents, for example, a document and/or file to be printed. As such, data 124 forms a print job for inkjet printing system 100 and includes one or more print job commands and/or command parameters.

In one example, electronic controller 110 controls printhead assembly 102 for ejection of ink drops from nozzles 116. Thus, electronic controller 110 defines a pattern of ejected ink drops which form characters, symbols, and/or other graphics or images on print media 118. The pattern of ejected ink drops is determined by the print job commands and/or command parameters.

Printhead assembly 102 includes one or more printheads 114. In one example, printhead assembly 102 is a wide-array or multi-head printhead assembly. In one implementation of a wide-array assembly, printhead assembly 102 includes a carrier that carries a plurality of printheads 114, provides electrical communication between printheads 114 and electronic controller 110, and provides fluidic communication between printheads 114 and ink supply assembly 104.

In one example, inkjet printing system 100 is a drop-on-demand thermal inkjet printing system wherein printhead 114 is a thermal inkjet (TIJ) printhead. The thermal inkjet printhead implements a thermal resistor ejection element in an ink chamber to vaporize ink and create bubbles that force ink or other fluid drops out of nozzles 116. In another example, inkjet printing system 100 is a drop-on-demand piezoelectric inkjet printing system wherein printhead 114 is a piezoelectric inkjet (PIJ) printhead that implements a piezoelectric material actuator as an ejection element to generate pressure pulses that force ink drops out of nozzles 116.

In one example, electronic controller 110 includes a flow circulation module 126 stored in a memory of controller 110. Flow circulation module 126 executes on electronic controller 110 (i.e., a processor of controller 110) to control the operation of one or more fluid actuators integrated as pump elements within printhead assembly 102 to control circulation of fluid within printhead assembly 102.

Figure 2A:
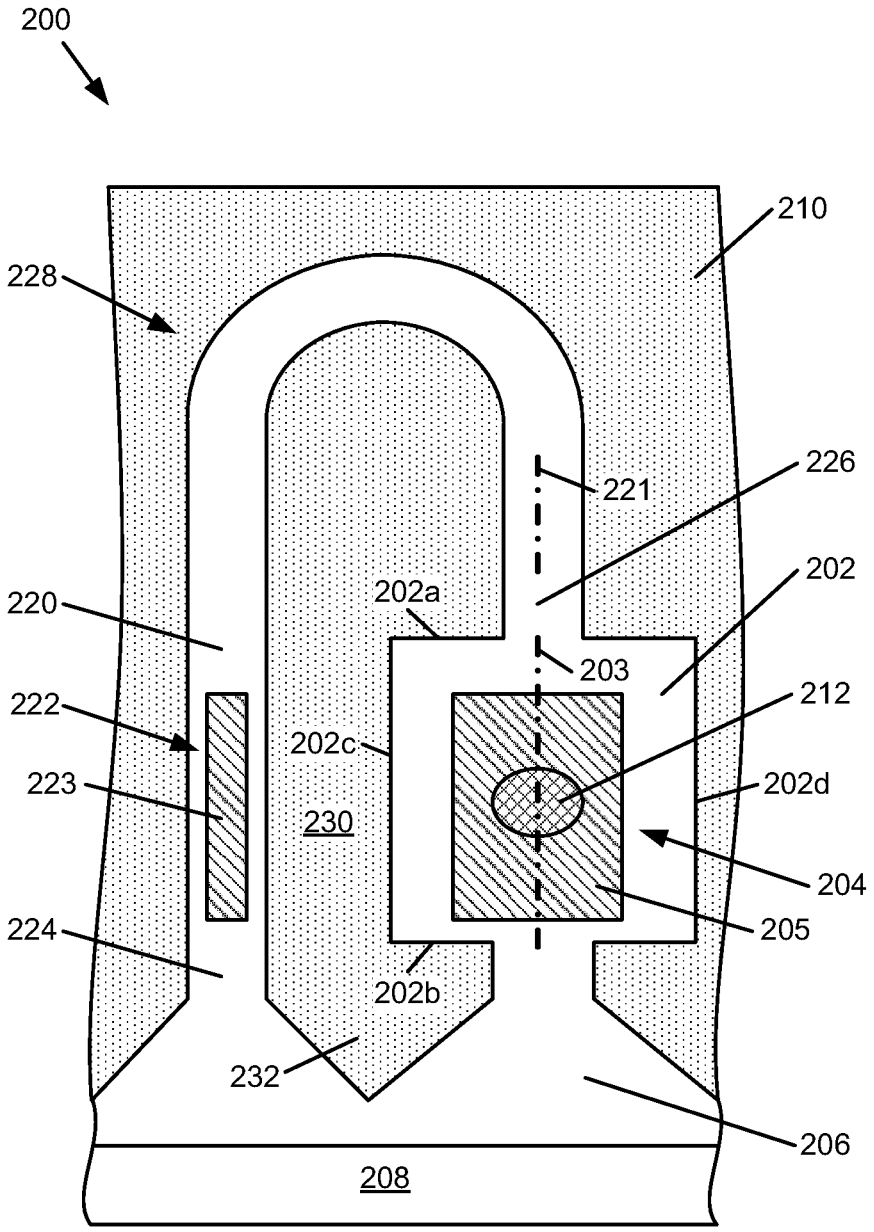
FIGS. 2A and 2B are schematic plan views illustrating one example of a portion of a fluid ejection device.

FIG. 2A is a schematic plan view illustrating one example of a portion of a fluid ejection device 200. Fluid ejection device 200 includes a fluid ejection chamber 202 and a corresponding drop ejecting element 204 formed or provided within fluid ejection chamber 202. Fluid ejection chamber 202 and drop ejecting element 204 are formed on a substrate 206 which has a fluid (or ink) feed slot 208 formed therein such that fluid feed slot 208 provides a supply of fluid (or ink) to fluid ejection chamber 202 and drop ejecting element 204. Substrate 206 may be formed, for example, of silicon, glass, or a stable polymer.

In one example, fluid ejection chamber 202 is formed in or defined by a barrier layer 210 provided on substrate 206. As such, fluid ejection chamber 202 includes opposite end walls 202*a* and 202*b*, and opposite sidewalls 202*c* and 202*d* such that fluid ejection chamber 202 provides a "well" in barrier layer 210. Barrier layer 210 may be formed, for example, of a photoimageable epoxy resin, such as SU8.

In one example, a nozzle or orifice layer (not shown) is formed or extended over barrier layer 210 such that a nozzle opening or orifice 212 formed in the orifice layer communicates with a respective fluid ejection chamber 202. Nozzle opening or orifice 212 may be of a circular, non-circular, or other shape.

Drop ejecting element 204 can be any device capable of ejecting fluid drops through corresponding nozzle opening or orifice 212. Examples of drop ejecting element 204 include a thermal resistor or a piezoelectric actuator. A thermal resistor, as an example of a drop ejecting element, is typically formed on a surface of a substrate (substrate 206), and includes a thin-film stack including an oxide layer, a metal layer, and a passivation layer such that, when activated, heat from the thermal resistor vaporizes fluid in fluid ejection chamber 202, thereby causing a bubble that ejects a drop of fluid through nozzle opening or orifice 212. A piezoelectric actuator, as an example of a drop ejecting element, generally includes a piezoelectric material provided on a moveable membrane communicated with fluid ejection chamber 202 such that, when activated, the piezoelectric material causes deflection of the membrane relative to fluid ejection chamber 202, thereby generating a pressure pulse that ejects a drop of fluid through nozzle opening or orifice 212.

As illustrated in the example of FIG. 2A, fluid ejection device 200 includes a fluid circulation channel 220 and a fluid circulating element 222 formed in, provided within, or communicated with fluid circulation channel 220. Fluid circulation channel 220 is open to and communicates at one end 224 with fluid feed slot 208 and communicates at another end 226 with fluid ejection chamber 202 such that fluid from fluid feed slot 208 circulates (or recirculates) through fluid circulation channel 220 and fluid ejection chamber 202 based on flow induced by fluid circulating element 222.

In the example illustrated in FIG. 2A, fluid circulation channel 220 is a U-shaped channel and includes a channel loop portion 228. As such, end 226 of fluid circulation channel 220 communicates with fluid ejection chamber 202 at end wall 202*a* of fluid ejection chamber 202.

In one example, fluid ejection chamber 202 and fluid circulation channel 220 are separated by a channel wall 230. In one example, a peninsula 232 extends from channel wall 230 toward fluid feed slot 208. In one example, channel wall 230 and peninsula 232 are formed by barrier layer 210 such that fluid circulation channel 220 is formed in or defined by barrier layer 210.

In the example illustrated in FIG. 2A, drop ejecting element 204 and fluid circulating element 222 are both thermal resistors. Each of the thermal resistors may include, for example, a single resistor, a split resistor, a comb resistor, or multiple resistors. A variety of other devices, however, can also be used to implement drop ejecting element 204 and fluid circulating element 222 including, for example, a piezoelectric actuator, an electrostatic (MEMS) membrane, a mechanical/impact driven membrane, a voice coil, a magneto-strictive drive, and so on. As referenced below, the thermal resistor of drop ejecting element 204 is referred to as main resistor 205, and the thermal resistor of fluid circulating element 222 is referred to as pump resistor 223.

Figure 2B:
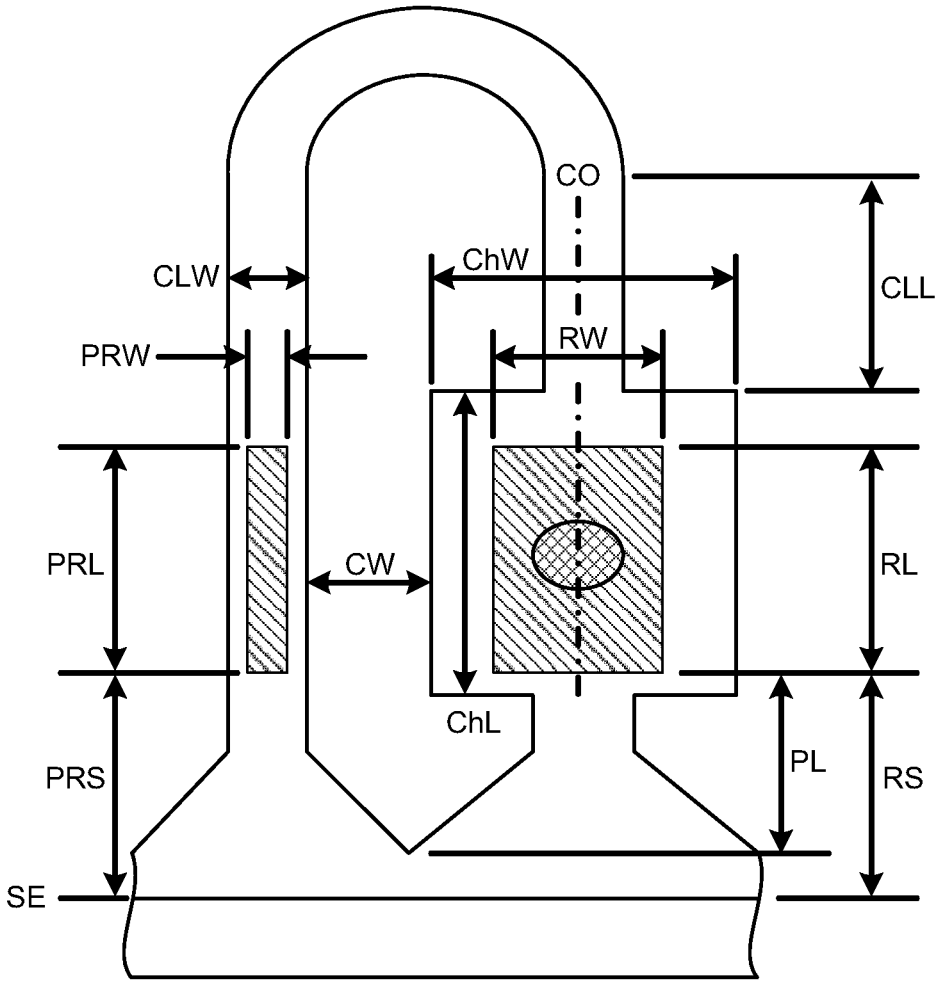

FIG. 2B is a schematic plan view illustrating one example of parameters of fluid ejection device 200. In one example, and as outlined in the table of FIG. 3, various parameters of fluid ejection device 200 are selected or defined to optimize performance of fluid ejection device 200.

With reference to FIGS. 2A and 2B, various parameters of fluid ejection device 200 are identified as follows:

RW—main resistor width
RL—main resistor length
RS—main resistor shelf length
PRW—pump resistor width
PRL—pump resistor length
PRS—pump resistor shelf length
ChW—main resistor chamber width
ChL—main resistor chamber length
CLW—circulation channel loop width
CLL—circulation channel loop length
CO—circulation channel offset
CW—channel wall width
PL—peninsula length
SE—fluid slot edge Notably, the main resistor shelf length (RS) and the pump resistor shelf length (PRS) are defined as a distance from the edge of main resistor 205 and the edge of pump resistor 223, respectively, to the edge (SE) of fluid feed slot 208.

Although the main resistor shelf length (RS) and the pump resistor shelf length (PRS) are illustrated as being the same, the main resistor shelf length (RS) and the pump resistor shelf length (PRS) may vary from each other. In addition, while fluid ejection chamber 202 is illustrated as being rectangular in shape, fluid ejection chamber 202 may be of other shapes.

In one example, the circulation channel loop width (CLW) of fluid circulation channel 220 is substantially uniform from and to and between end 224 and end 226. In addition, the circulation channel loop length (CLL) is defined as a distance from end wall 202*a* of fluid ejection chamber 202 to a point of curvature of channel loop portion 228 of fluid circulation channel 220. Furthermore, the circulation channel offset (CO) is defined as a distance between a centerline or axis of symmetry 203 of fluid ejection chamber 202 and a centerline or axis of symmetry 221 of fluid circulation channel 220. As illustrated in the example of FIG. 2B, the circulation channel offset (CO) is zero (0) such that fluid circulation channel 220 is axisymmetrical with fluid ejection chamber 202. The circulation channel offset (CO), however, may vary as end 226 of fluid circulation channel 220 is positioned along end wall 202*a* of fluid ejection chamber 202.

Channel wall width (CW) is defined as a distance between fluid ejection chamber 202 and fluid circulation channel 220. More specifically, in one example, channel wall width (CW) is defined as a distance between sidewall 202*c* of fluid ejection chamber 202 and a sidewall of a portion of fluid circulation channel 220 in which pump resistor 223 is positioned. As such, and as illustrated in the examples of FIGS. 2A and 2B, channel wall width (CW) is measured in a direction substantially perpendicular to the axis of symmetry 203 of fluid ejection chamber 202. Furthermore, peninsula length (PL) is defined as a distance from an end of main resistor 205 (namely, an end of main resistor 205 closest to fluid feed slot 208) to an end of peninsula 232 (namely, an end of peninsula 232 closest to fluid feed slot 208).

FIG. 3 is a table outlining example ranges, more specifically, lower levels and upper levels of parameters of fluid ejection device 200. In one example, channel wall width (CW) is based on circulation channel loop width (CLW) and main resistor chamber width (ChW), and circulation channel loop width (CLW) is based on channel wall width (CW) and main resistor chamber width (ChW). As such, channel wall width (CW) and circulation channel loop width (CLW) are both based on main resistor chamber width (ChW).

More specifically, in one example, channel wall width (CW) is defined by the following equation:

$$CW=(42-CLW-ChW)/2$$

where CLW=circulation channel loop width (microns), and ChW=main resistor chamber width (microns).

In addition, in one example, circulation channel loop width (CLW) is defined by the following equation:

$$CLW=42-2CW-ChW$$

where CW=channel wall width (microns), and ChW=main resistor chamber width (microns).

Figure 4:
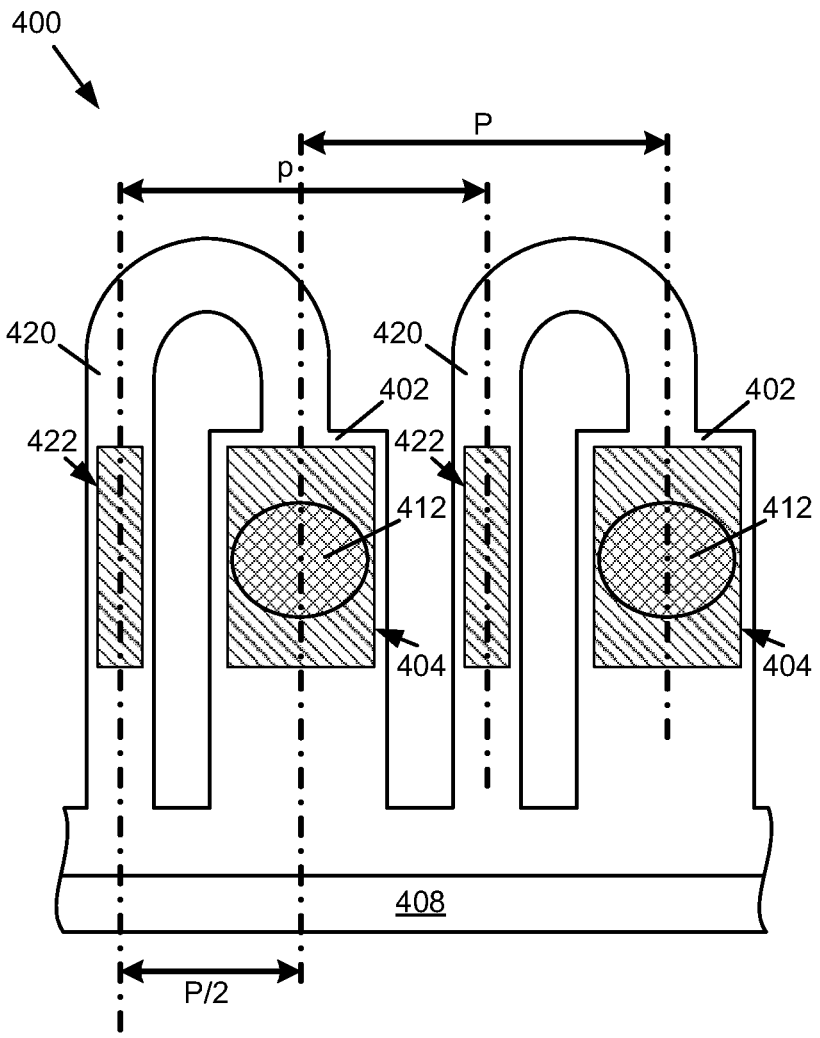
FIG. 4 is a schematic plan view illustrating one example of a portion of a fluid ejection device.

FIG. 4 is a schematic plan view illustrating one example of a portion of a fluid ejection device 400. Fluid ejection device 400 includes a plurality of fluid ejection chambers 402 and a plurality of fluid circulation channels 420. Similar to that described above, fluid ejection chambers 402 each include a drop ejecting element 404 with a corresponding nozzle opening or orifice 412, and fluid circulation channels 420 each include a fluid circulating element 422.

In one example, fluid ejection chambers 402, including associated drop ejecting elements 404 with corresponding nozzle openings or orifices 412, and fluid circulation channels 420, including associated fluid circulating elements 422, are evenly arranged, or are an equal distance apart from one another, along a length of fluid feed slot 408. More specifically, in one example, a distance or pitch P between adjacent drop ejecting elements 404 (and corresponding nozzle openings or orifices 412) is substantially equal to a distance or pitch p between adjacent fluid circulating elements 422. In addition, in one example, a distance or spacing between a drop ejecting element 404 and an associated fluid circulating element 422 is approximately one-half of pitch P between adjacent drop ejecting elements 404 (namely, P/2).

As illustrated in the examples of FIGS. 2A, 2B, and FIG. 4, each fluid circulation channel 220, 420 communicates with one (i.e., a single) fluid ejection chamber 202, 402. As such, fluid ejection devices 200 and 400 each have a 1:1 nozzle-to-pump ratio. With a 1:1 ratio, circulation is individually provided for each fluid ejection chamber 202, 402, thereby enabling efficient circulation servicing of every nozzle.

Figure 5:
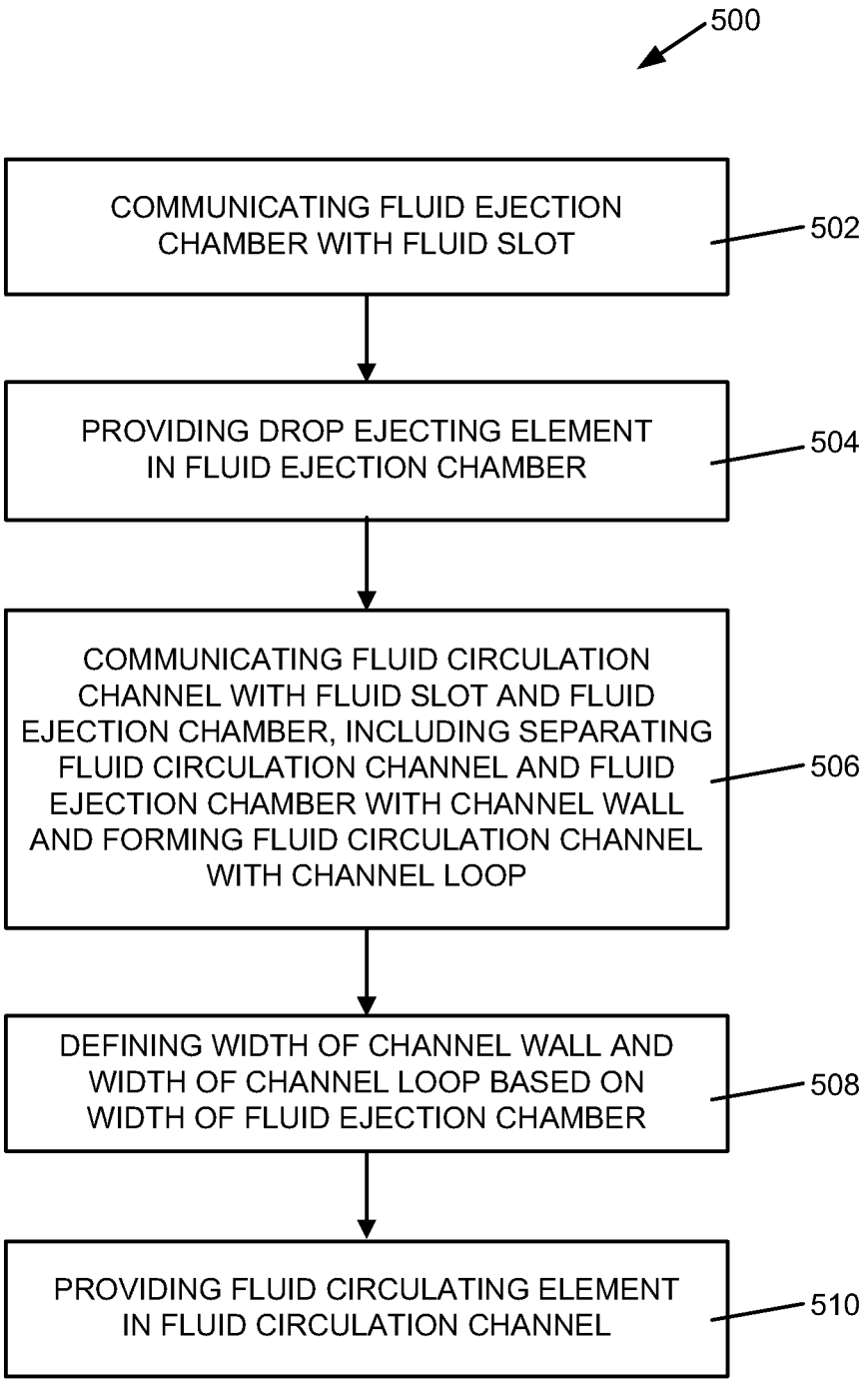
FIG. 5 is a flow diagram illustrating one example of a method of forming a fluid ejection device.

FIG. 5 is a flow diagram illustrating one example of a method 500 of forming a fluid ejection device, such as fluid ejection device 200 as illustrated in the examples of FIGS. 2A and 2B.

At 502, method 500 includes communicating a fluid ejection chamber, such as fluid ejection chamber 202, with a fluid slot, such as fluid feed slot 208.

At 504, method 500 includes providing a drop ejecting element, such as drop ejecting element 204, in the fluid ejection chamber, such as fluid ejection chamber 202.

At 506, method 500 includes communicating a fluid circulation channel, such as fluid circulation channel 220, with the fluid slot and the fluid ejection chamber, such as fluid feed slot 208 and fluid ejection chamber 202. In this regard, 506 of method 500 includes separating the fluid circulation channel, such as fluid circulation channel 220, and the fluid ejection chamber, such as fluid ejection chamber 202, with a channel wall, such as channel wall 230, and forming the fluid circulation channel, such as fluid circulation channel 220, with a channel loop, such as channel loop portion 228.

At 508, method 500 includes defining a width of the channel wall, such as channel wall width (CW), and a width of the channel loop, such as circulation channel loop width (CLW), based on a width of the fluid ejection chamber, such as main resistor chamber width (ChW).

At 510, method 500 includes providing a fluid circulating element, such as fluid circulating element 222, in the fluid circulation channel, such as fluid circulation channel 220.

Although illustrated and described as separate and/or sequential steps, the method of forming the fluid ejection device may include a different order or sequence of steps, and may combine one or more steps or perform one or more steps concurrently, partially or wholly.

With a fluid ejection device including circulation as described herein, ink blockage and/or clogging is reduced. As such, decap time and, therefore, nozzle health are improved. In addition, pigment-ink vehicle separation and viscous ink plug formation are reduced or eliminated. Furthermore, ink efficiency is improved by lowering ink consumption during servicing (e.g., minimizing spitting of ink to keep nozzles healthy). In addition, a fluid ejection device including circulation as described herein, helps to manage air bubbles by purging air bubbles from the ejection chamber during circulation.

Although specific examples have been illustrated and described herein, it will be appreciated by those of ordinary skill in the art that a variety of alternate and/or equivalent implementations may be substituted for the specific examples shown and described without departing from the scope of the present disclosure. This application is intended to cover any adaptations or variations of the specific examples discussed herein.

What is claimed is:

1. A fluid ejection device, comprising:

a fluid slot;

multiple fluid circulation channels, wherein:

each fluid circulation channel is communicated at one end with the fluid slot; and communicated at another end with a fluid ejection chamber, which fluid ejection chamber is communicated with the fluid slot to form a loop; and a fluid circulating element disposed in each fluid circulation channel to cycle fluid through a respective fluid circulation channel.

2. The fluid ejection device of claim 1, wherein the loop is U-shaped.

3. The fluid ejection device of claim 1, further comprising a channel wall between each fluid circulation channel and corresponding fluid ejection chamber.

4. The fluid ejection device of claim 3, wherein a channel wall width is based on a channel loop width.

5. The fluid ejection device of claim 3, wherein a channel wall width is based on an ejection chamber width.

6. The fluid ejection device of claim 1, further comprising a drop ejecting element disposed within the fluid ejection chamber.

7. The fluid ejection device of claim 6, wherein the drop ejecting element and the fluid circulating element are a same distance away from an edge of the fluid slot.

8. A fluid ejection device, comprising:

a fluid slot;

multiple fluid circulation loops communicated at both ends to the fluid slot, wherein each fluid circulation loop is defined by a channel wall selected based on a width of the circulation loop; and a fluid circulating element disposed in each fluid circulation channel to cycle fluid through a respective fluid circulation loop.

9. The fluid ejection device of claim 8, wherein the fluid circulation loops are formed in a barrier layer disposed on a substrate.

10. The fluid ejection device of claim 8, further comprising a peninsula extending from the channel wall towards the fluid slot.

11. A printing system, comprising:

a reservoir to hold fluid to be ejected; and a printhead assembly comprising:

a fluid slot;

a number of nozzles to eject fluid towards a print medium, wherein each nozzle is disposed in a fluid ejection chamber that forms part of a fluid circulation channel communicated at both ends to a fluid slot; and a pump disposed in each fluid circulation channel to cycle fluid through a respective fluid circulation channel.

12. The printing system of claim 11, wherein the fluid ejection chamber is wider than a respective fluid circulation channel.

13. The printing system of claim 11, wherein a channel loop width is based on a chamber width.

14. The printing system of claim 11, wherein a ratio of nozzles to pumps in each fluid circulation channel is 1:1.

15. The printing system of claim 11, wherein the printing system is an inkjet cartridge.

* * * * *